US005613900A

United States Patent [19]

Ramsey

[11] Patent Number: 5,613,900

[45] Date of Patent: Mar. 25, 1997

[54] CLEANING AND DESCALING APPARATUS

[75] Inventor: Henry Ramsey, Dudley, Mass.

[73] Assignee: L&P Property Management Company, Chicago, Ill.

[21] Appl. No.: 495,343

[22] Filed: Jun. 27, 1995

[51] Int. Cl.[6] ..... B24B 21/02

[52] U.S. Cl. ..... 451/299; 451/296

[58] Field of Search ..... 451/296, 299, 451/311, 310, 211

[56] References Cited

U.S. PATENT DOCUMENTS

| | | | |
|---|---|---|---|
| 2,105,612 | 1/1938 | Pallas | 451/299 |
| 2,284,904 | 6/1942 | Illmer et al. | 451/296 |
| 2,804,196 | 8/1957 | Planett | 72/39 |
| 3,124,908 | 3/1964 | Wing et al. | 451/415 |
| 3,304,661 | 2/1967 | Maguire | 451/211 |
| 3,432,971 | 3/1969 | Conti | 451/194 |
| 3,559,348 | 2/1971 | Case | 451/299 |
| 3,633,318 | 1/1972 | Olivotto | 451/211 |
| 3,665,649 | 5/1972 | Krejan et al. | 451/299 |
| 4,045,837 | 9/1977 | Mandras | 15/104.04 |
| 4,218,800 | 8/1980 | Przygocki | 15/88 |

*Primary Examiner*—Robert A. Rose

*Attorney, Agent, or Firm*—Wood, Herron & Evans, P.L.L.

[57] ABSTRACT

An abrading apparatus for cleaning an outer surface of an elongate member, such as a wire. An endless abrasive sanding belt is rotated about a plurality of rollers and orbited about the elongate member. Drive components for both rotating the belt about the rollers as well as orbiting the belt about the elongate member are isolated in an enclosed drive casing containing lubricating fluid, such as oil. A first roller which mounts the endless sanding belt is fixed in a rotatable eccentric support. This eccentric support allows the tension of the endless belt to be adjusted by rotating the eccentric support in one of two directions. One of the rollers includes a mounting portion and a belt supporting portion, with the mounting portion being axially offset or eccentric with respect to the belt supporting portion. A belt engagement and disengagement mechanism is connected to the eccentric mounting portion of the idler roller to allow rotation of the eccentric mounting portion in two directions.

18 Claims, 4 Drawing Sheets

3
3

CLEANING AND DESCALING APPARATUS

BACKGROUND OF THE INVENTION

The present invention generally relates to abrasively cleaning burrs, scales and the like from elongate cylindrical objects such as metallic rod, pipe and, especially, continuous strands of wire.

One known type of machine for abrasively cleaning a continuous wire strand uses a rotating sanding belt which orbits about the wire as the wire is pulled past and against the belt. A machine of this basic variety is disclosed in U.S. Pat. No. 3,559,348. This machine effectively abrades and cleans the entire outside or circumferential surface of the wire by simply pulling the wire through the machine. Two types of rotation and, therefore, two types of drives are used in this machine. One drive rotates an endless sanding belt mounted transverse to and in contact with the wire, while another drive orbits the entire sanding belt about the wire such that the entire outer circumference is abraded as the wire travels past the sanding belt.

While machines of this type have been generally quite efficient and successful, certain areas for further improvements exist and are addressed by the present invention. One involves the life of the drive components used to both rotate and orbit the sanding belt with respect to the wire strand. As these machines are often continuously used in high volume production runs, the drive components tend to wear out from the combination of the continuous operation of the machine and the adverse effects of having the gritty by-products of the descaling operation infiltrate the drive mechanisms.

Another problem of past abrading machines of the type disclosed in U.S. Pat. No. 3,559,348 involves the ability to tension the sanding belt to maintain proper tracking and to maintain forceful contact between the belt and the wire strand as the belt is orbited about the wire. The tensioning system disclosed in U.S. Pat. No. 3,559,348 is quite complicated in design and has many components which increase the cost of the machine and the propensity for the machine to break down. Another need involves the ability to easily remove and replace the sanding belt.

There is, therefore, a need for an abrading machine which is relatively more simple in construction than past machines, but which has various advantages over such past machines. These advantages would include longer drive life, simpler belt tensioning or tracking adjustment, and easier belt removal and replacement.

SUMMARY OF THE INVENTION

To these ends, the present invention provides an abrading apparatus for cleaning an outer surface of an elongate member, such as a wire, with the apparatus including an endless abrasive sanding belt rotated about a plurality of rollers and orbited about the elongate member. In accordance with one aspect of this invention, drive components for both rotating the belt about the rollers as well as orbiting the belt about the elongate member are isolated in an enclosed drive casing containing lubricating fluid, such as oil. This case therefore not only maintains these drive components isolated from the abrasive byproducts of the cleaning operation, but lubricates the components at the same time. A stationary housing contains the drive casing, the endless sanding belt and the rollers. The casing is mounted to a support member of the housing by bearings and is rotated to orbit the endless sanding belt about the elongate member. The rollers are fixed in bearings mounted in the casing.

In a second aspect of the invention, a first roller which mounts the endless sanding belt is fixed in a rotatable eccentric support. This eccentric support allows the tension of the endless belt to be adjusted by rotating the eccentric support in one of two directions. Rotation in one direction moves the first roller toward a second roller and rotation in the opposite direction moves the first roller away from the second roller. In the preferred embodiment, the first roller is an idler roller while the second roller is a driven roller. The eccentric support forms part of a bearing assembly which mounts the first roller to the drive casing. The eccentric support is connected to a handle for manually turning the eccentric support to adjust the belt tension or tracking and a selectively engageable lock is provided for locking the handle and the eccentric support in place.

In a third aspect of the invention, one of the rollers includes a mounting portion and a belt supporting portion, with the mounting portion being axially offset or eccentric with respect to the belt supporting portion. Preferably, it is the first or idler roller which includes this eccentric mounting portion. A belt engagement and disengagement mechanism is connected to the eccentric mounting portion of the idler roller to allow rotation of the eccentric mounting portion in two directions. Rotation in one direction moves the roller portion, i.e., the idler roller toward the drive roller to a belt release position and rotation in an opposite direction moves the idler roller away from the drive roller to a belt engagement position. A linkage assembly is connected to the eccentric mounting portion and is actuable by a handle to effect rotation of the eccentric mounting portion. The handle is pivotally mounted to a handle support, which is preferably the drive casing. The linkage assembly more specifically includes a first link connected to the eccentric mounting portion of the idler roller and a second link pivotally connected between the first link and the handle. A spring is connected between the first link and the handle to retain the linkage assembly and therefore the idler roller in one of the two positions.

The belt drive and the orbital drive of this invention comprise a main gear and a drive gear operatively connected together such that the drive gear rotates about the main gear. The drive gear is rigidly connected to the drive roller to rotate the drive roller as the drive gear rotates about the main gear. In the preferred embodiment, the main gear and the drive gear are connected by a gear belt or "silent chain" and the main gear is stationary. A drive shaft is rigidly connected to the drive casing and operatively connected to a motor output for rotating the drive shaft, the casing and any support provided for the elongate member being cleaned. Preferably, the support for the elongate member is one which is fixed in axial relationship to the drive shaft and the drive shaft further includes an axial bore which receives the elongate member, such as a wire, being fed linearly therethrough.

Further objects and advantages of this invention will become more readily apparent to those of ordinary skill upon review of the following detailed description of the preferred embodiment taken in conjunction with the accompanying drawings.

DETAILED DESCRIPTION OF THE PREFERRED EMBODIMENT

Figure 1:
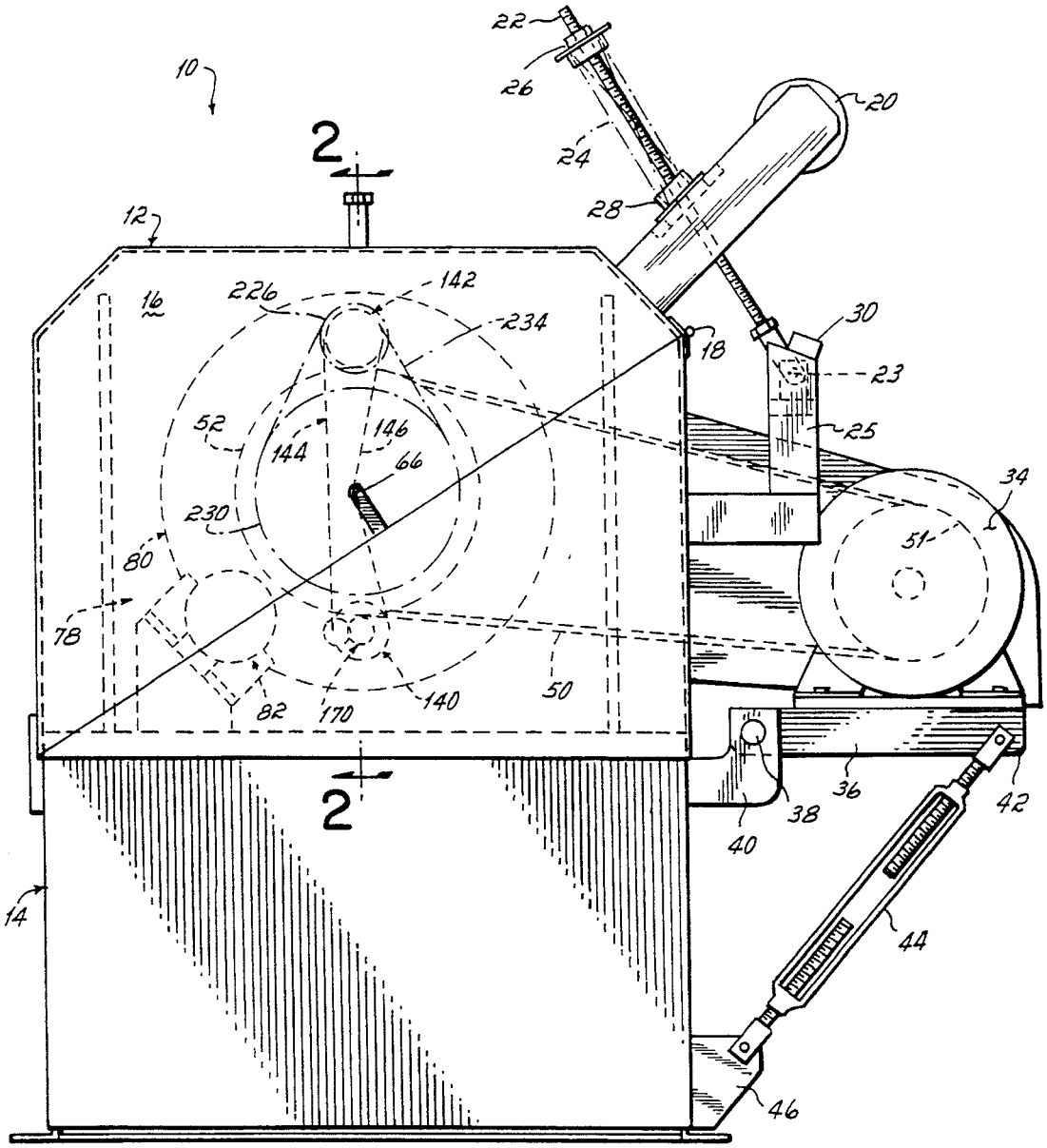
FIG. 1 is a side elevational view of a cleaning and descaling apparatus constructted in accordance with the present invention.

Referring to FIG. 1, a cleaning and descaling apparatus 10 is shown and generally includes an upper housing 12 and a lower support base 14. Upper housing 12 includes a cover 16 which may be opened and closed by a hinged connection 18 to allow access to the various components of the apparatus inside as will be discussed below. A counterweight 20 is provided for assisting in opening cover 16 and is connected to a threaded rod 22 connected by a pivot 23 on a support 25 extending from upper housing 12. At the upper end of threaded rod 22, a compression spring 24 is mounted between an adjustment nut 26 and a spring mount 28 connected to counterweight 20. A stop 30 is provided on support 25 for stopping counterweight 20 and cover 16 at a fully opened position. Adjustment nut 26 may be threaded and moved upwardly and downwardly along threaded rod 22 to change the compression of spring 24 and thereby change the counterbalancing effect of counterweight 20.

As further shown in FIG. 1, a motor 34 is provided for operating various components within housing 12 as will be described further below. Motor 34 is fixed to a mount 36 which is supported by a pivot connection 38 on a support 40 on one side and by turn buckles 44 (only one of which is shown) pivotally connected between a lower support 46 extending from base 14 and an outside edge portion 42 of mount 36.

Figure 2:
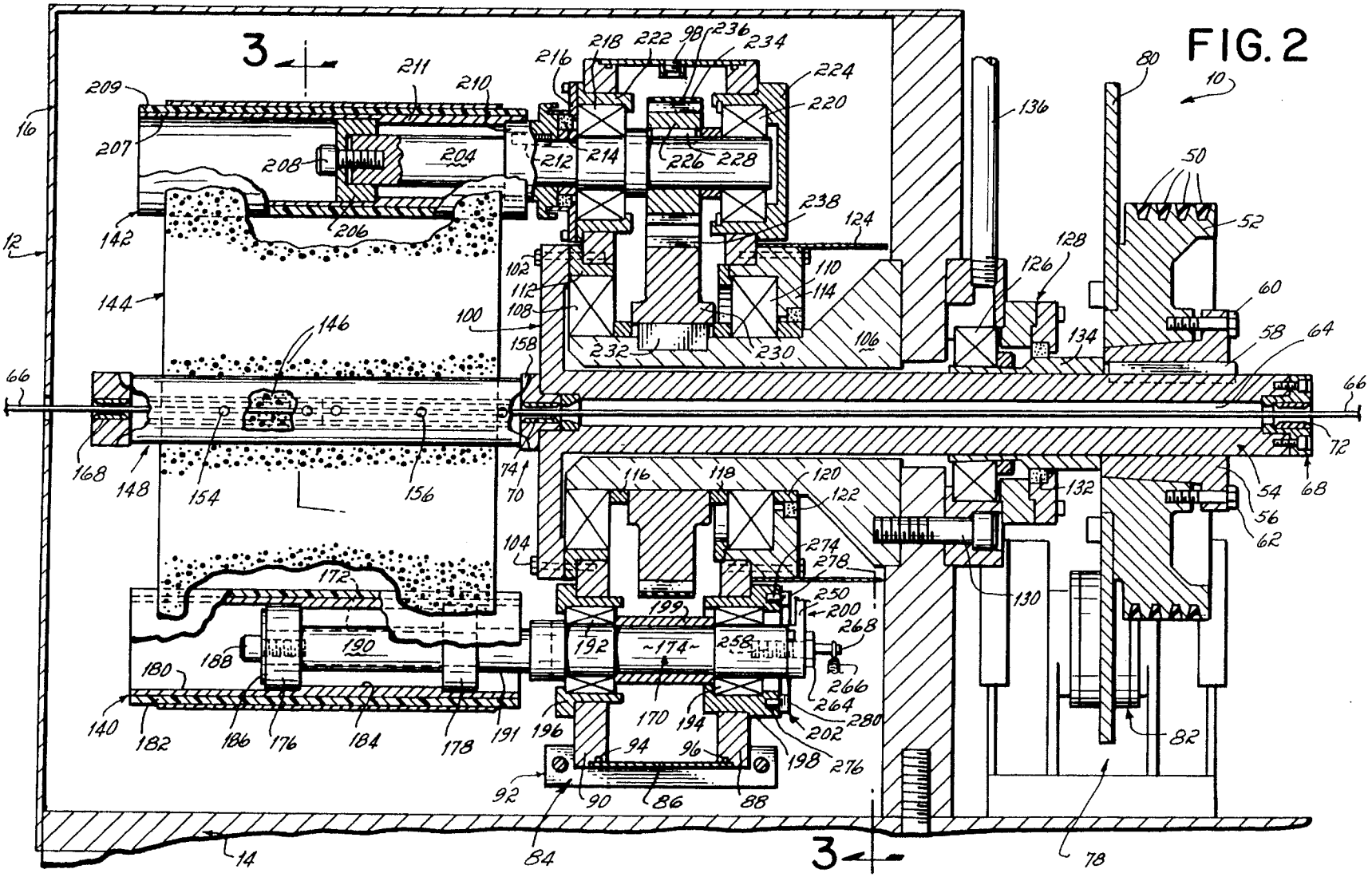
FIG. 2 is a cross sectional view taken along line 2—2 of FIG. 1.

Referring now mainly to FIG. 2, a drive belt 50 extends from an output 51 of motor 34 to a drive sheave 52. Drive sheave 52 is rigidly fastened to a drive shaft 54 which extends into housing 12. Specifically, a tapered mounting 56 is connected to drive shaft 54 by a key 58 into drive sheave 52 by fasteners 60, 62, only two of which are shown. Drive shaft 54 includes a central bore 64 for receiving the elongate member, such as a wire 66 to be fed in a linear fashion therethrough into housing 12 where it is abrasively cleaned, in a manner to be described below. Wire guides 68, 70 are provided at opposite ends of drive shaft 54 and include carbide bushings 72, 74 for guiding and restraining lateral movement of wire 66. A brake assembly 78 is provided for stopping the rotation of drive shaft 54 and specifically comprises a conventional disk 80 and caliber assembly 82.

Still referring to FIG. 2, a sealed drive casing 84 is rotatable mounted within housing 12 and rotated by drive shaft 54. Drive casing 84 includes an annular cover 86 and a pair of side plates 88, 90 with cover 86 being fastened onto side plates 88, 90 by a connecting clamp or bracket 92. A pair of annular seals 94, 96 are disposed between the periphery of the respective side plates 88, 90 and annular cover 86. Annular cover is provided with a port 98 for filling drive casing 84 with lubricating fluid such as oil.

A flange portion 100 of drive shaft 54 is rigidly secured to side plate 90 of drive casing 84 by fasteners 102, 104, only two of which are shown. Drive casing 84 is supported for rotation on a rigid, stationary support 106 within housing 12 by a pair of bearings 108, 110. Bearings 108, 110 are suitably fixed on support 106 by bearing holders 112, 114 and respective spacer members 116, 118, 120. An annular seal 122 is provided between bearing holder 114 and spacer member 120. An annular shield 124 is fixed to bearing holder 114 and surrounds the casing support 106 to keep excessive dust, etc., from entering the area of seal 122. Drive shaft 54 is also supported for rotation by a further bearing 126 held within a bearing mount assembly 128 which is rigidly fastened to housing 12 by bolts 130, only one of which is shown in FIG. 2. An annular seal 132 is provided between bearing mount assembly 128 and a mounting portion 134 of drive shaft 54. Finally, a vent 136 is provided for venting housing 12 when apparatus 10 is in use.

As also shown in FIG. 2, secured for rotation to drive casing 84 are a pair of rollers 140, 142. First roller 140 is preferably an idler roller, while second roller 142 is a drive roller. An endless sanding belt 144 having an abrasive outer surface 146 is mounted on rollers 142, 144. An elongate wire guide or support 148 is mounted therebetween for rotation with drive shaft 54.

Figure 6:
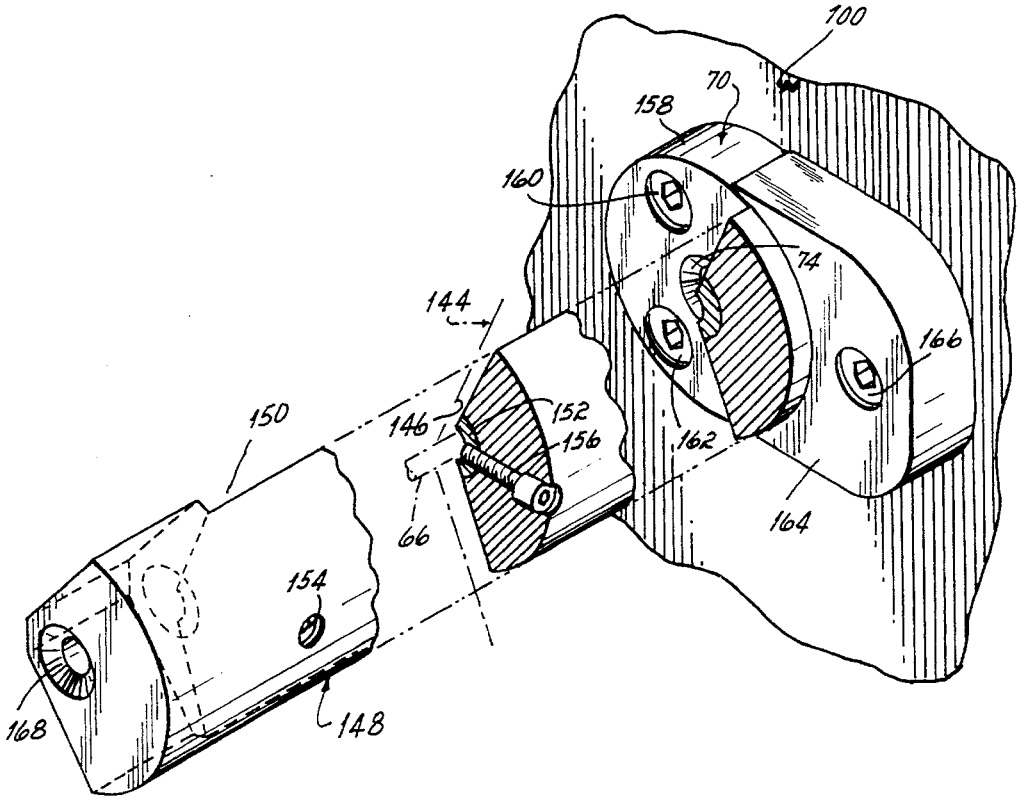
FIG. 6 is a perspective view of the support for the elongate member and its attachment to the drive shaft of the apparatus.

Referring briefly to FIG. 6, wire guide or support 148 more specifically comprises an elongate member having a recess 150 for accommodating endless sanding belt 144 without the sanding belt 144 contacting wire guide 148. One or more carbide strips 152 are fixed to wire guide 148 with fasteners 154, 156 and are partially circular in cross sectional shape such that they bear against the outside surface of wire 66. A mounting flange 158 is formed at one end of wire guide 148 and is rigidly secured to flange portion 100 of drive shaft 54 by screw fasteners 160, 162. On the opposite side of wire guide 148 from flange portion 158, a restraining plate 164 is affixed to flange portion 1 00 by a separate screw fastener 166. Finally, the outer end of wire guide 148 includes a cylindrical carbide bushing 168 which further guides wire 66 as it travels linearly through wire guide 148.

Figure 4:
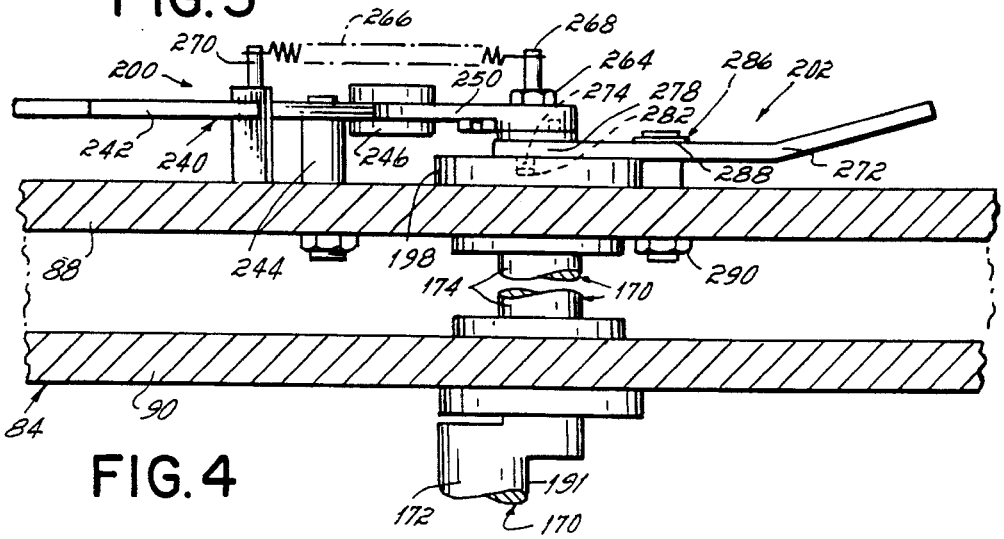
FIG. 4 illustrates the belt tensioning mechanism and the belt release mechanism of the invention and is taken generally along 4—4 of FIG. 3.

Turning back to FIG. 2, the rotational and orbital drive of endless sanding belt 144 will now be described. Roller 140 is rotationally supported by an eccentric rod 170. Eccentric rod 170 includes both a roller portion 172 and a mounting portion 174 with portions 172, 174 being axially offset from each other as best shown in FIG. 4. Roller 140 more specifically comprises a steel cylindrical core 180 having a frictional coating, such as a rubber or polymeric coating 182 which frictionally engages endless sanding belt 144. Roller 140 is supported for rotational movement on rod portion 172 by a pair of roller bearings 176, 178. Steel core 180 includes an inner stepped portion 184 against which roller bearings 176, 178 are held. Roller bearing 176 is held against one side of stepped portion 184 by a retaining plate 186 and a fastener 188 which extends into roller portion 172 or rod 170. Roller bearing 178 is held between the other end of stepped portion 184 and a sleeve or larger diameter portion 190 of roller portion 172. The roller portion also includes, opposite the sleeve portion 190, an enlarged diameter 191 against which the entire roller assembly (roller bearings 176, 178 and sleeve 190) is secured by the fastener 188.

Mounting portion 174 of eccentric rod 170 is held for rotation within casing 84 by a pair of spherical bearings 192, 194. Bearings 192, 194 only allow rotation during adjustment of the tracking or tension of sanding belt 144 as will be described below. Spherical bearings 192, 194 are respectively held in bearing mounts 196, 198 and a cylindrical oil seal 199 is disposed therebetween. As will be discussed below, a sanding belt engagement and disengagement mechanism 200 is connected to mounting portion 174 or eccentric rod 170 and a belt tensionsing or tracking mechanism 202 is connected to bearing mount 198 for providing a fine tracking or tensioning adjustment for sanding belt 144 as will also be discussed below.

A straight rod 204 mounts second roller 142 and provides rotational driving of sanding belt 144 about rollers 140, 142. Rod 204 is rigidly affixed to roller 142 by a center bushing 206 which is secured to an outer end of rod 204 by a bolt 208 and an end bushing or mount 210 which is press fit or otherwise rigidly secured to an inner end of roller 142. Like roller 140, roller 142 is preferably formed with a steel core 207 having a frictional coating, such as a rubber or polymeric coating 209. A steel core 207 includes a stepped portion 211 against which bushings 206, 210 are mounted. A key 212 fixes end bushing 210 to shaft 204 for rotation therewith. A seal 214 is provided within a seal holder 216 and between end bushing 210 and a first roller bearing 218 of a pair of roller bearings 218, 220 which mount an inner end of rod 204 within drive casing 84. Respective bearing mounts 222, 224 hold bearings 218, 220.

A drive gear 226 is rigidly secured to drive rod 204 within drive casing 84, preferably by a key 228. A main gear 230 is rigidly secured to stationary casing support 106 by another key 232. An endless gear belt or silent chain 234 extends around both a drive gear 226 and main gear 230 and includes teeth which engage respective teeth 236, 238 on drive gear 226 and main gear 230. It will thus be appreciated that, as drive shaft 54 is rotated, the entire drive casing 84 will be rotated about stationary drive casing support 106 because of the rigid connection between flange portion 100 or drive shaft 54 and side plate 90 of drive casing 84. This will likewise rotate drive gear 226 about the stationary main gear 230 and, at the same time, gear belt or silent chain 234 will rotate drive gear 226 about the axis of drive rod 204, thereby rotating drive rod 204 and roller 142. As wire guide 148 is also rigidly secured to drive shaft 54, it too will rotate about wire 66 as it supports wire 66 from a side always opposite to abrasive surface 146 of sanding belt 144.

Figure 5:
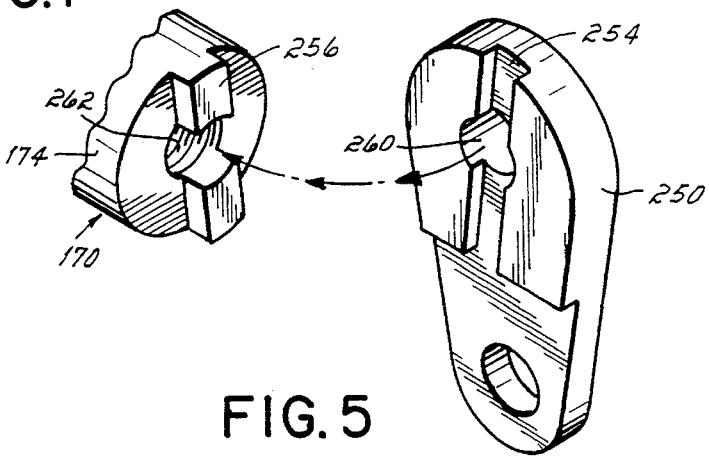
FIG. 5 is a perspective view of a link in the belt release mechanism and its attachment to the idler roller of the apparatus.
Figure 3:
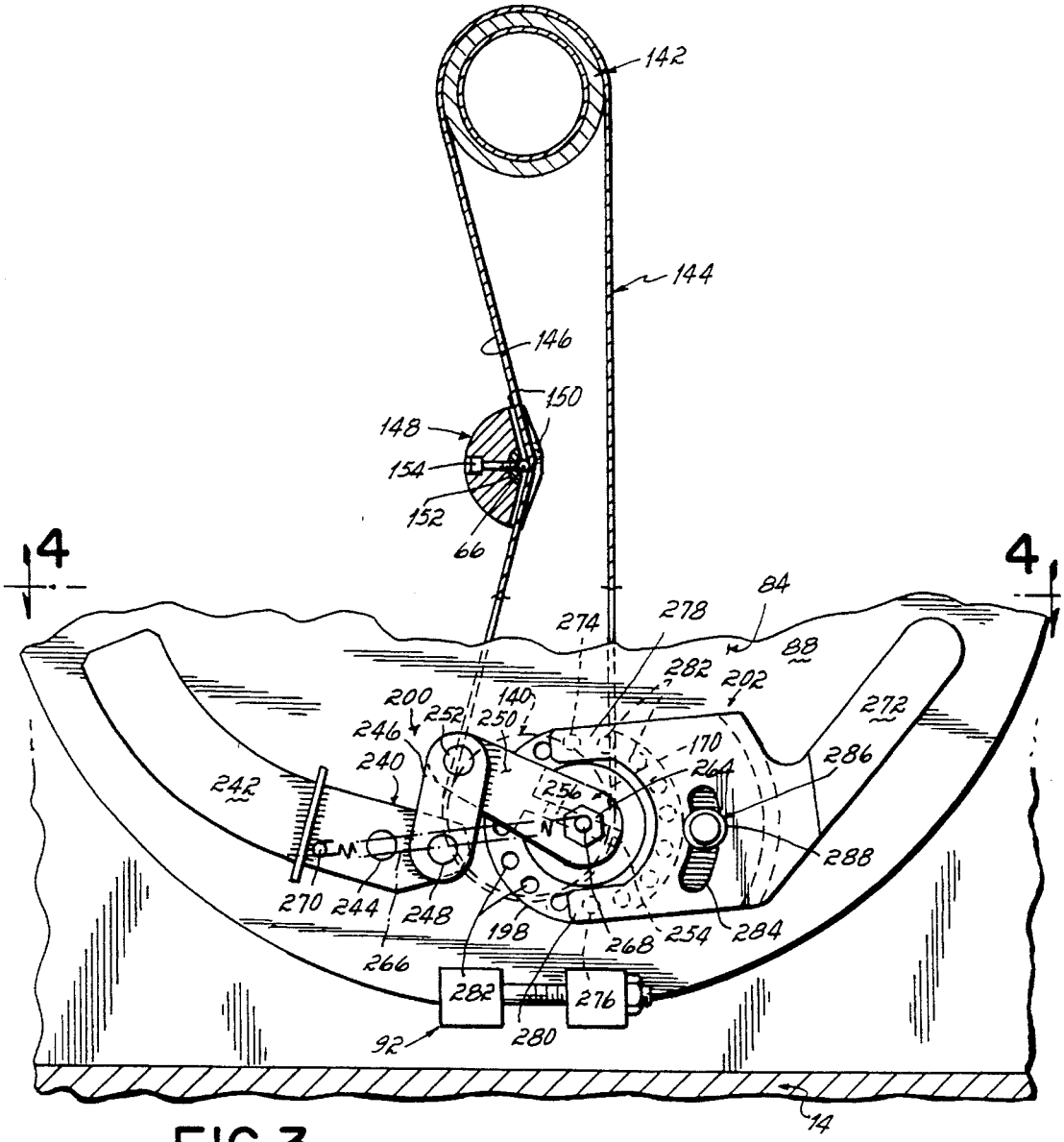
FIG. 3 is a crossesectional view taken generally along line 3—3 of FIG. 2.
Figure 3A:
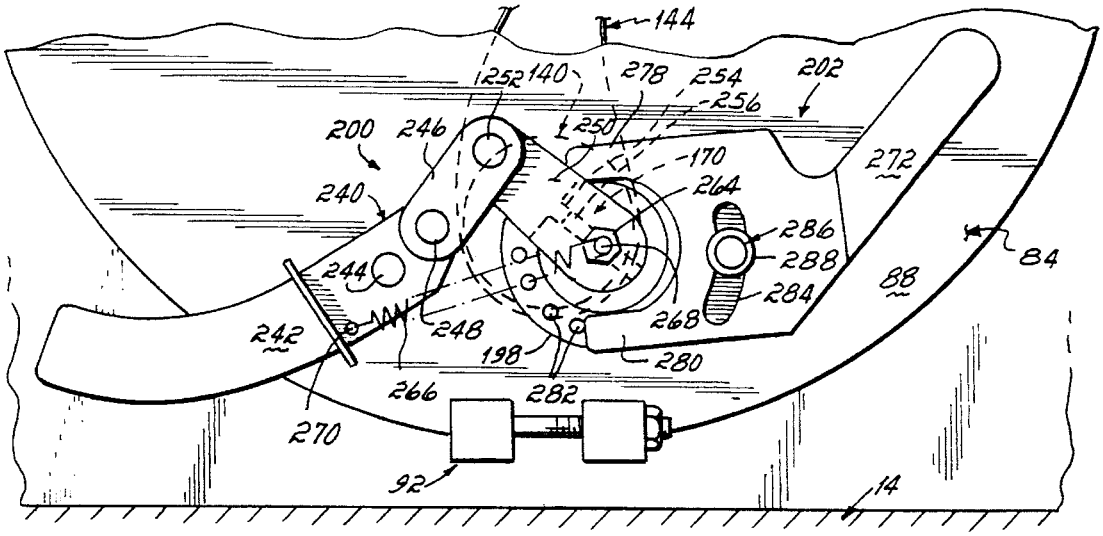
FIG. 3A is a view similar to FIG. 3 but showing the belt in a disengaged position.

Referring now to FIGS. 3 and 4, belt engagement and disengagement mechanism 200 more specifically comprises a linkage mechanism 240 which is connected to eccentric rod 170 and, more particularly, to mounting portion 174 thereof. As best shown in FIGS. 3 and 3A, linkage assembly 240 comprises a handle 242 which is affixed to drive casing side plate 88 by a pivot connection 244 and is further connected at its outer end to a connecting link 246 by a second pivot connection 248. The opposite end of connecting link 46 is connected to a crank 250 by a pivot connection 252 which rotates eccentric rod 170 (FIG. 4). Referring now briefly to FIG. 5, crank 250 is connected to mounting portion 174 of eccentric rod 170 by way of a recess or slot 254 contained in crank 250 which receives a projection 256 extending outwardly from the end of mounting rod portion 174. As best shown in FIG. 2, mounting portion 174 of eccentric rod 170 receives a threaded fastener 258 which extends through a hole 260 in crank 250 and is tightened into a threaded hole 262 in the end of mounting portion 174 (FIG. 5). As further shown in FIGS. 3, 3A and 4, the head end 264 of fastener 258 secures the crank 250 onto the end of mounting rod portion 174. A spring 266 is connected between a spring pin 268 which is an extension on the end of fastener 258 and a second spring pin 270 secured to handle 242. It will be appreciated that with spring 266 disposed just above pivot connection 248 as shown in FIG. 3, the force of spring 266 helps maintain linkage assembly 240 in the engaged position shown in FIG. 3. With spring 266 disposed below pivot connection 248, linkage assembly 240 is maintained in the disengaged position as shown in FIG. 3A. Movement of handle 242 by an operator in a downward direction pivots crank 250 clockwise as shown in FIG. 3 thereby also rotating mounting portion 174 of eccentric rod 170 clockwise about the axis thereof and, at the same time, rotating roller portion 172 of eccentric rod 170 about the axis of mounting portion 74 in an upward direction or toward roller 142 (FIG. 2). This releases belt 144 as shown in FIG. 3A such that belt 144 may be removed and replaced. Once belt 144 has been replaced or mounted onto rollers 140, 142, handle 242 may again be moved to its upward position as shown in FIG. 3 thereby rotating crank 250 in a counterclockwise direction and moving roller portion 72 of eccentric rod 170 downwardly about the axis of mounting portion 174 to cause roller 140 to engage belt 144 and apply the necessary tension.

Still referring to FIGS. 3, 3A and 4, a belt tensioning or tracking mechanism 202 is also provided to provide a fine adjustment to the tension of belt 144 to thereby optimize the tracking of belt 144 about rollers 140, 142. Specifically, belt tensioning or tracking mechanism 202 includes a handle 272 which is connected to bearing mount 198 by a pair of pins 274, 276 which extend from a respective pair of arms 278, 280 of handle 272. Pins 274, 276 engage two holes 282 selected from a plurality of such holes 282 on an outer periphery of bearing mount 198. Bearing mount 198 includes an eccentric mount as will be appreciated from FIG. 2 and is mounted for rotation within side plate 88 of drive casing 84. It will be appreciated from FIG. 2 that rotation of bearing mount 198 by way of handle 272 will move eccentric rod 172 slightly upward or downward depending on the direction of rotation such that tension applied to belt 144 will be slightly increased or decreased by relative upward or downward movement of roller 140 with respect to roller 142. In this regard, bearing 192 provides enough "play" or, in other words, allows enough upward and downward movement as viewed in FIG. 2 to allow this fine adjustment to be made. As further shown in FIGS. 3 and 3A, a curved slot 284 is provided in handle 272 and cooperates with a clamping assembly 286 to secure handle 272 and, therefore, bearing mount 198 in the desired position. In this regard, a ring 288 bears against the outside of handle 272 on opposite sides of slot 284 as shown in FIGS. 3 and 3A, while a nut 290 is provided on the opposite side of clamping assembly 286 to tighten the assembly 286 down and hold handle 272 in a fixed position. It will be appreciated that an access may be provided into drive casing 84 to allow tightening of nut 290 or, alternatively, nut 290 may be provided on the outside of handle 272 adjacent slot 284.

Operation

Although the operation of apparatus 10 should be understood by those of skill in the art from the foregoing description, a brief description of the operation will be provided for clarity. Prior to the operation of apparatus 10, endless sanding belt 144 may be mounted onto rollers 140, 142 by moving belt engagement disengagement mechanism 200 into the disengaged position shown in FIG. 3A. Belt 144 may then be tensioned between rollers 140 and 142 by moving mechanism 200 into the position shown in FIG. 3 and fine adjustment of the belt tension may be performed by loosening clamp assembly 286 and appropriately rotating handle 272 to adjust bearing mount 198 to thereby move roller rod portion 172 of eccentric rod 170 either slightly upward toward roller 142 or downward and away from roller 142 depending on whether less or more tension is required. Referring to FIG. 2, drive shaft 54 is rotated by drive belt 50 and drive sheave 52. Rotation of drive shaft 54 rotates drive casing 84 about casing support 106 via bearings 108, 110. This rotates drive gear 226 about stationary main gear 230 thereby orbiting rollers 140, 142 and sanding belt 144 and also rotating wire guide 148 about wire 66. At the same time, gear belt or silent chain 234 rotates drive gear 26 and therefore drive rod 204 and drive roller 142 to rotate endless sanding belt 144 about rollers 140, 142. During this operation, wire 66 is drawn in a linear fashion through carbide bushing 72, central bore 64 of drive shaft 54, carbide bushing 74, wire guide 148 which includes carbide bushing strips 152 and, finally, carbide bushing 168, all of which support wire 66 as sanding belt 144 bears and rotates against the entire outer peripheral surface thereof during the orbiting operation.

Although a detailed description of a preferred embodiment of this invention has been provided above, it will readily appreciated by those of ordinary skill in the art that many modifications and substitutions of components may be made without departing from the spirit and scope, of the invention. It is therefore Applicant's intention to only be bound by the scope of the claims appended hereto and not to the specific details provided in this specification.

What is claimed is:

1. An abrading apparatus for cleaning an outer surface of an elongate member, the apparatus comprising:

an elongate support having a central axis for supporting said elongate member;

an endless belt having an abrasive surface and mounted for rotation between first and second spaced apart rollers such that said abrasive surface is disposed adjacent said elongate support;

a belt driving mechanism operatively connected to said first and second rollers for rotating said rollers and said belt;

an orbital drive mechanism connected to said first and second rollers for rotating said endless belt and said rollers about said elongate member; and, a sealed casing having a radially outermost portion rotatable about said axis containing and isolating said orbital drive mechanism, said sealed casing containing lubricating fluid for said orbital drive mechanism.

2. The apparatus of claim 1 wherein said orbital drive mechanism comprises a main gear and a drive gear operatively connected together such that said drive gear rotates about said main gear, said drive gear further being rigidly connected to said first roller to rotate said first roller upon rotation of said drive gear about said main gear.

3. The apparatus of claim 2 wherein said main gear and said drive gear are connected by a gear belt.

4. The apparatus of claim 2 further comprising a drive shaft rigidly connected to said casing and said elongate support and operatively connected to a motor output for rotating said drive shaft, said casing and said elongate support.

5. The apparatus of claim 4 wherein said drive shaft includes an axial bore for receiving said elongate member, and said elongate support is fixed in axial relationship to said drive shaft.

6. The apparatus of claim 5 further comprising a stationary housing for enclosing said casing, said endless belt and said rollers, wherein said main gear is rigidly connected to a support member of said housing and said casing is mounted to the support member of said housing by bearings and said drive shaft rotates said drive gear about said main gear.

7. The apparatus of claim 1 wherein said rollers are fixed in bearings mounted in said casing.

8. An abrading apparatus for cleaning an outer surface of an elongate member, the apparatus comprising:

an elongate support for supporting said elongate member;

an endless belt having an abrasive surface and mounted for rotation between a pair of spaced apart rollers such that said abrasive surface is disposed adjacent said elongate support;

a belt driving mechanism operatively connected to said rollers for rotating said rollers and said belt;

an orbital drive mechanism connected to said rollers for rotating said endless belt and said rollers about said elongate member; and, wherein one of said rollers is fixed in a rotatable eccentric support for allowing tension of said endless belt to be adjusted, whereby rotation of the eccentric support in one direction moves said one roller toward the other roller and rotation of the eccentric support in an opposite direction moves said one roller away from the other roller.

9. The apparatus of claim 8 wherein the eccentric support forms part of a bearing assembly which mounts said one roller to said casing.

10. The apparatus of claim 9 wherein said one roller includes an eccentric mounting portion which is supported by said bearing assembly.

11. The apparatus of claim 8 further comprising:

a handle connected to the eccentric support for turning the eccentric support, and a selectively engageable lock operatively connected to said handle for locking said handle and eccentric support in place.

12. The apparatus of claim 8 wherein said belt driving mechanism includes a drive gear and said orbital drive mechanism is formed by an interconnection of said drive gear with a main gear, said drive gear and said main gear being sealed in a casing containing lubricating fluid.

13. An abrading apparatus for cleaning an outer surface of an elongate member, the apparatus comprising:

an elongate support for supporting said elongate member;

an endless belt having an abrasive surface and mounted for rotation between a pair of spaced apart rollers such that said abrasive surface is disposed adjacent said elongate support;

a belt driving mechanism operatively connected to said rollers for rotating said rollers and said belt;

an orbital drive mechanism connected to said rollers for rotating said endless belt and said rollers about said elongate member; and, wherein one of said rollers includes an eccentric mounting portion and a belt release mechanism is connected to said eccentric mounting portion to allow rotation of said eccentric mounting portion in two directions, whereby rotation in one direction moves said one roller toward the other roller to a belt release position and rotation in an opposite direction moves said one roller away from the other roller to a belt engagement position.

14. The apparatus of claim 13 further comprising a linkage assembly connected to said eccentric mounting portion, wherein pivoting of said linkage assembly rotates said eccentric mounting portion.

15. The apparatus of claim 14 further comprising a handle connected to said linkage assembly.

16. The apparatus of claim 15 wherein said handle is pivotally mounted to a handle support and said linkage assembly includes a first link connected to said eccentric mounting portion and a second link pivotally connected between said first link and said handle.

17. The apparatus of claim 16 further comprising a spring connected between said first link and said handle.

18. The apparatus of claim 13 wherein said belt driving mechanism includes a drive gear and said orbital drive mechanism is formed by an interconnection of said drive gear with a main gear, said drive gear and said main gear being sealed in a casing containing lubricating fluid.

* * * * *